United States Patent [19]

Murai et al.

[11] Patent Number: 4,773,228

[45] Date of Patent: Sep. 27, 1988

[54] CRYOSTAT

[75] Inventors: Takashi Murai; Shinichi Masuno, both of Kobe, Japan

[73] Assignee: Mitsubishi Denki Kabushiki Kaisha, Japan

[21] Appl. No.: 89,446

[22] Filed: Aug. 26, 1987

[30] Foreign Application Priority Data

Mar. 9, 1986 [JP] Japan ..... 61-135703[U]

[51] Int. Cl.[4] ..... F17C 7/02

[52] U.S. Cl. ..... 62/55; 62/514 R

[58] Field of Search ..... 62/55, 514 R

[56] References Cited

U.S. PATENT DOCUMENTS 2,764,873 10/1956 Mooyaart ..... 62/55
3,972,202 8/1976 Stearns ..... 62/55
4,198,828 4/1980 Mercier et al. ..... 62/55

FOREIGN PATENT DOCUMENTS 60-78111 5/1985 Japan .

*Primary Examiner*—Ronald C. Capossela
*Attorney, Agent, or Firm*—Leydig, Voit & Mayer

[57] ABSTRACT

A cryostat comprising a cryogenic vessel for storing a cryogen therein, a port pipe disposed at a portion of the vessel for holding one end of a supply pipe for supplying the cryogen to the vessel thereby allowing the cryogen to flow into the vessel while the very low temperature liquid cryogen is being supplied from the exterior to the vessel, and a cryogen supply pipe disposed in the vessel so as to be spaced apart from the port pipe, further the cryogen supply pipe having a receiving portion for receiving the cryogen from the supply pipe during the supply of the cryogen.

2 Claims, 3 Drawing Sheets

CRYOSTAT

BACKGROUND OF THE INVENTION

1. Field of the Invention

The present invention relates generally to a cryostat for adiabatically storing very low temperature liquid cryogens and, in particular, to a structure for supplying a liquid cryogen to the interior of the cryostat.

2. Description of the Prior Art

FIG. 1 is a diagrammatic, cross section of one example of the structure of a prior-art cryostat disclosed in Japanese Utility Model Laid-open No. 78111/1985. As shown, the prior-art cryostat comprises a vessel 100 including an inner wall 1 serving to define a tank for storing a very low temperature liquid cryogen 5 and an outer shell 2 for accommodating the inner wall 1. A cryogen supply pipe 3 serves to guide the very low temperature cryogen 5 which is supplied from a storage container 7 through a supply pipe 8 to the bottom of the inner wall 1. An outlet 4 is disposed for allowing discharge of the gases resulting from the evaporation of the very low temperature liquid cryogen 5. A superconducting coil 6 is housed in the space defined by the inner wall 1 in such a manner as to be submerged in the very low temperature liquid cryogen 5. The supply pipe 8 is held by a port pipe 9 at the top of the vessel 100 and extends into the pipe 9 toward the lower end thereof. The cryogen supply pipe 3 extends from the lower end of the port pipe 9 towards the lower portion of the inner wall 1. The very low temperature liquid cryogen 5 can thus be introduced through the cryogen supply pipe 3 into the bottom of the inner wall 1.

The following is a description of the operation of the aforesaid prior-art cryostat. The inner wall 1 and the outer shell 2 are combined with each other to form a kind of vacuum bottle, and thus the vacuum space defined therebetween provide heat insulation. The very low temperature liquid cryogen 5 is supplied from the storage container 7 into the interior of the inner wall 1 through the supply pipe 8, the port pipe 9 and the cryogen supply pipe 3. The very low temperature liquid cryogen 5 is thus accommodated in the space defined by the inner wall 1. The thus-accommodated liquid cryogen 5 is caused to evaporate under the influence of various thermal factors such as heat conducted from the exterior and a slight quantity of heat generated by the superconducting coil 6 disposed in the space defined by the inner wall 1. The gas resulting from such evaporation of the liquid cryogen 5 is discharged through the outlet 4.

The aforesaid conventional type of cryostat has a structure in which a room-temperature side is connected to a very-low-temperature side through the path formed by the supply pipe, the part pipe and the cryogen supply pipe. This structure may conduct unwanted heat from the exterior to the very low temperature liquid cryogen accommodated in the vessel, and this might correspondingly accelerate the evaporation rate of the accommodated liquid cryogen. This phenomenon may lead to the problem that the operating period of the superconducting coil per unit supply of the very low temperature liquid cryogen is shortened.

SUMMARY OF THE INVENTION

It is therefore an object of the present invention to provide a cryostat capable of substantially preventing heat from being conducted from the exterior to the very low temperature liquid cryogen stored in its vessel, thereby providing a solution to the aforesaid problem.

This object is achieved by the present invention which provides a cryostat comprising a structure in which a port pipe fixedly receives a supply pipe, which is is separated from a cryogen supply pipe to eliminate the direct connection between a room-temperature side and a very-low-temperature side so that unwanted heat is substantially prevented from being connected through the port pipe and the cryogen supply pipe, thereby minimizing the quantity of a very low temperature liquid cryogen which is caused to evaporate through operation of a superconducting coil.

In particular, the present invention relates to an improvement in a cryostat comprising: a vessel for storing a very low temperature liquid cryogen; a port pipe disposed at a portion of the vessel for holding one end of a supply pipes for supplying the very low temperature liquid cryogen to the vessel while the very low temperature liquid is being supplied from the exterior to the vessel, thereby allowing the very low temperature liquid cryogen to flow into the vessel; and a cryogen supply pipe disposed in the vessel for guiding the very low temperature liquid cryogen delivered from the supply pipe to a lower end of the vessel, the cryogen supply pipe being spaced apart from the port pipe, with said cryogen supply pipe having a receiving portion for receiving the very low temperature liquid cryogen from the supply pipe while the cryogen is being supplied.

In accordance with the present invention, the port pipe is separated from the cryogen supply pipe by a gap therebetween to break a path which may conduct unwanted heat, thereby substantially preventing unwanted heat from being conducted from the exterior to the very low temperature liquid cryogen accommodated in the vessel.

Further objects, features and advantages of the present invention will become apparent from the following description of preferred embodiments of the present invention with reference to the accompanying drawings.

DESCRIPTION OF THE PREFERRED EMBODIMENTS

Figure 1:
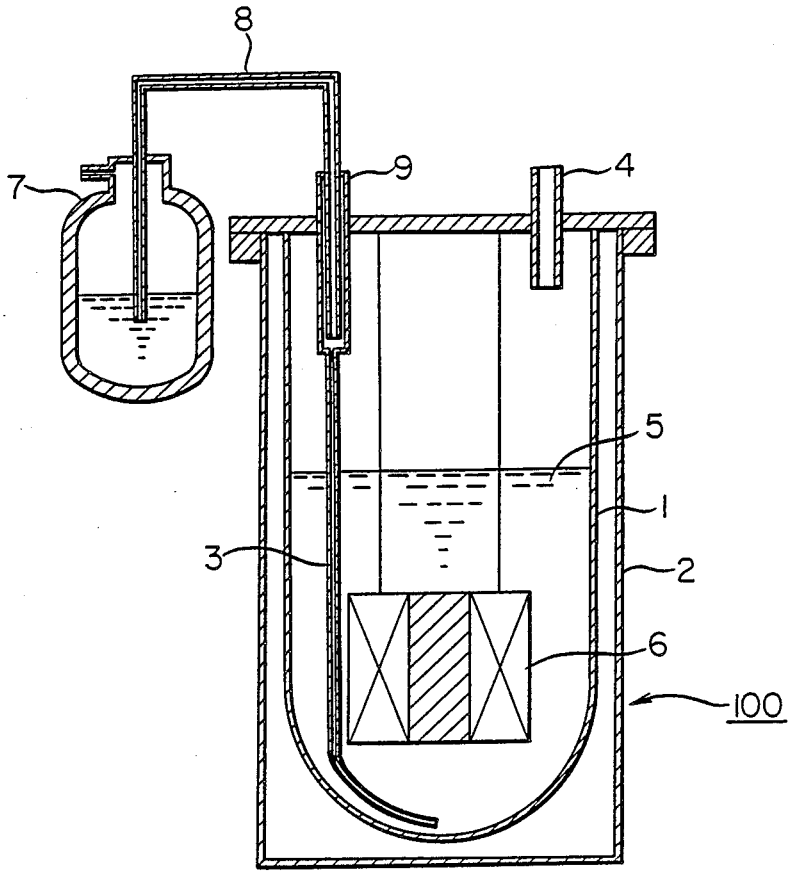
FIG. 1 PRIOR ART
FIG. 1 is a diagrammatic, cross section of one example of the structure of a cryostat of the prior art.

Preferred embodiments of the present invention will be described below with reference to the accompanying drawings in which like reference numerals are used to denote like or corresponding elements.

Figure 2:
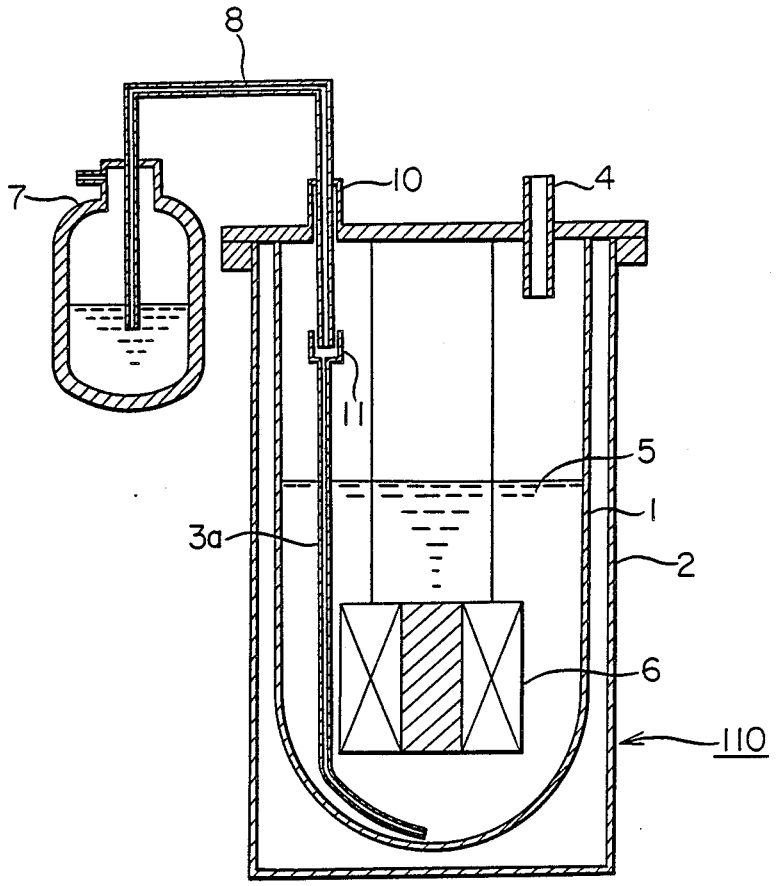
FIG. 2 is a diagrammatic, cross section of the structure of a first preferred embodiment of a cryostat of the present invention.

FIG. 2 is a diagrammatic, cross section of the structure of a first preferred embodiment of a cryostat of the present invention. The cryostat shown in FIG. 2 includes: a port pipe connecting portion 10 for holding the supply pipe 8 during the supply of the very low temperature liquid cryogen at the top of a vessel 110 and for introducing the supply pipe 8 into the space defined by the inner wall 1; and the cryogen supply pipe 3*a* for guiding the very low temperature liquid cryogen 5 delivered through the supply pipe 8 to the interior space of the inner wall 1. However, the port pipe 10 and the cryogen supply pipe 3*a* are disposed in separate relationship with each other so as to have a gap formed therebetween. In addition, the supply pipe 8 and the cryogen supply pipe 3*a* are disposed so as that the cryogen 5 delivered from the supply pipe 8 may be received by the cryogen supply pipe 3*a*. The cryogen supply pipe 3*a* has an upper end integral with a receiving portion 11 for receiving the cryogen 5 which is delivered from the supply pipe 8.

It is to be noted that, although not shown specifically in FIG. 2, the cryogen supply pipe 3*a* is adiabatically supported on the inner wall 1, for example, via an adiabatic support member. In respect of the remaining elements, the first embodiment is the same as the prior-art example shown in FIG. 1, and the description is omitted.

The following is a description of the operation of the first embodiment of the present invention.

Referring again to FIG. 2, the very low temperature liquid cryogen 5 is supplied from the storage container 7, then passed through the supply pipe 8, the receiving portion 11 and the liquid supply pipe 3*a*, and then introduced into the interior space of the inner wall 1. After completion of the supply of the very low temperature liquid cryogen 5, the supply pipe 8 is removed from the vessel 110 when the superconducting coil 6 is in operation and/or while the liquid cryogen 5 is accommodated in the vessel 110. In addition, as illustrated, the port pipe 10 is separated from the cryogen supply pipe 3*a* so as to have a gap between them. Accordingly, it is possible to prevent unwanted heat from being conducted from a room-temperature side to the very low temperature liquid cryogen accommodated in the vessel 110, i.e, through the conducting path formed by the port pipe 10 and the cryogen supply pipe 3*a*. In consequence, it is possible to reduce the evaporation rate of the liquid cryogen 5 in the vessel 110, and this enables an extension of the operating period of the superconducting coil 6 per unit supply of the very low temperature liquid cryogen 5.

Figure 3:
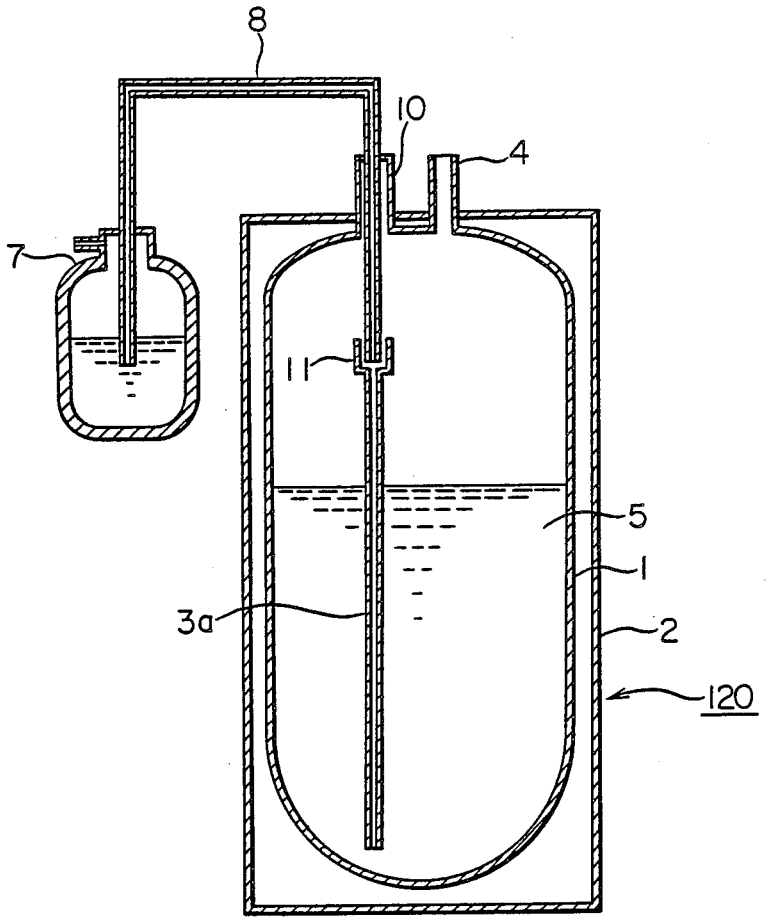
FIG. 3 is a diagrammatic, cross section of the structure of a second preferred embodiment of a cryostat of the present invention.

In the above description of the first preferred embodiment, reference is made to a case where the vessel 110 includes the inner wall 1 serving to define the space in which the superconducting coil 6 is accommodated. FIG. 3 is a cross section of a second embodiment of the present invention, but showing a vessel 120 which accommodates and holds only the very low temperature liquid cryogen 5 but includes no conducting coil. Of course, the function of the aforesaid first embodiment can also be achieved by the second embodiment.

The port pipe 10 shown in FIGS. 2 and 3 is integral with the top of the vessel 110 and the inner wall 1 of the vessel 120, respectively. However, the port pipe 10 may be separately prepared and attached to the top of the vessel 110 or the inner wall 1 of the vessel 120.

What is claimed is:

1. A cryostat comprising a cryogenic vessel for storing a cryogen therein; a port pipe disposed at a portion of said vessel for holding one end of a supply pipe for supplying the cryogen to the vessel thereby allowing said cryogen to flow into said vessel while said very low temperature liquid is being supplied from the exterior to said vessel; and a cryogen supply pipe disposed in said vessel for guiding said cryogen delivered from the supply pipe into a lower end of said vessel, said cryogen supply pipe being spaced apart from said port pipe, with said cryogen supply pipe having a receiving portion for receiving the cryogen from said supply pipe while the cryogen is being supplied.

2. A cryostat according to claim 1, wherein said vessel for storing said very low temperature liquid cryogen accommodates a superconducting coil.

* * * * *

UNITED STATES PATENT AND TRADEMARK OFFICE

CERTIFICATE OF CORRECTION

PATENT NO. : 4,773,228

DATED : September 27, 1988

INVENTOR(S) : Murai et al

It is certified that error appears in the above-identified patent and that said Letters Patent is hereby corrected as shown below:

On the title page (30) Foreign Application Priority Data should read

-- September 3, 1986 (JP) Japan .....61-135703(U) --.

Signed and Sealed this

Fourteenth Day of February, 1989

*Attest:*

DONALD J. QUIGG

*Attesting Officer*

*Commissioner of Patents and Trademarks*